US006019811A

United States Patent [19]

Schlienger et al.

[11] Patent Number: 6,019,811

[45] Date of Patent: Feb. 1, 2000

[54] METALS PROCESSING CONTROL BY COUNTING MOLTEN METAL DROPLETS

[75] Inventors: Eric Schlienger, Albuquerque, N.Mex.; Joanna M. Robertson, Safford, Ariz.; David Melgaard, Albuquerque, N.Mex.; Gregory J. Shelmidine, Tijeras, N.Mex.; James A. Van Den Avyle, Corrales, N.Mex.

[73] Assignee: Sandia Corporation, Albuquerque, N.Mex.

[21] Appl. No.: 08/910,821

[22] Filed: Aug. 13, 1997

[51] Int. Cl.[7] ..... C21B 11/10

[52] U.S. Cl. ..... 75/10.12; 75/10.24; 75/386

[58] Field of Search ..... 75/10.12, 386, 75/387, 10.24, 10.25, 10.64

[56] References Cited

U.S. PATENT DOCUMENTS

| | | | |
|---|---|---|---|
| 5,348,566 | 9/1994 | Sawyer et al. | 75/10.24 |
| 5,617,911 | 4/1997 | Sterett et al. | 164/457 |

OTHER PUBLICATIONS

*EPRI*(*Electric Power Research Institute*), "Electroslag Processing: State–of–the–Art Assessment," EPRI EM—4992 Project 2570–1, Center for Metals Production, Pittsburgh PA (Oct. 1987) pp S–1—9–1).

Ballantyne, A.S., et al., "The Influence of Melting Rate on Structure in VAR and ESR Ingots," reference source: *Proc. 5*[th]*International Conf. Voc. Met. & ESR*, pp 181–183 (No month, 1976).

Mitchell, A., "Process Limitations of ESR and VAR for high–Quality Allows", *Prespectives in Metalurgical Development*, Pul: The Metals Society, London, Sheffield, England Jul. 16–18, 1984 (pp 89–98).

Mitchell, A., "Theory and Practice of Electroslag Melting", *Journ of Vacuum Sci and Tech*, vol. 7, No. 8, pp 863–873 (Nov. –Dec. 1970).

Mitchell, A., "Factors Affecting Solidification and ingot Temperatures in ESR," 39[th] *Electric Furnace Conf Proc, Electric Furnace Div, Iron and Steel Soc*(*AIMM & P Eng.*), vol. 39 pp 569–598 (Apr. 23–27, 1979).

*Primary Examiner*—Scott Kastler
*Assistant Examiner*—Tima McGuthry-Banks
*Attorney, Agent, or Firm*—George H. Libman

[57] ABSTRACT

Apparatus and method for controlling metals processing (e.g., ESR) by melting a metal ingot and counting molten metal droplets during melting. An approximate amount of metal in each droplet is determined, and a melt rate is computed therefrom. Impedance of the melting circuit is monitored, such as by calculating by root mean square a voltage and current of the circuit and dividing the calculated current into the calculated voltage. Analysis of the impedance signal is performed to look for a trace characteristic of formation of a molten metal droplet, such as by examining skew rate, curvature, or a higher moment.

10 Claims, 5 Drawing Sheets

METALS PROCESSING CONTROL BY COUNTING MOLTEN METAL DROPLETS

GOVERNMENT RIGHTS

The Government has rights to this invention pursuant to Contract No. DE-AC04-94AL85000 awarded by the U.S. Department of Energy.

BACKGROUND OF THE INVENTION

1. Field of the Invention (Technical Field)

The present invention relates to apparatuses and methods for maintaining as constant as possible the melt rate during electro-slag remelting (ESR).

2. Background Art

In ESR melting, considerable effort is expended on control methodologies designed to keep the melt rate as constant as possible. The rationale behind these efforts is that, during the steady state portion of the melt, a constant melt rate leads to a constant solidification rate. Therefore, the ability to operate at a constant (and proper) solidification rate greatly increases the is likelihood that an ingot will be produced without solidification defects. In addition, a constant melt rate provides an environment where the reaction rates between the slag and molten metal remain constant as well. This results in a constant purification rate of the metal being processed and will eliminate variation in impurity levels.

Typical melt rate control schemes differentiate the data from a strain gauge based load cell system in order to obtain a melt rate. This method has numerous flaws. First, the mechanical system is prone to noise sources such as mechanical stiction, water pressure variations, electrical noise, and vibrations. Second, the melting current variations can cause changes in apparent weight, and third, buoyancy effects caused by the immersion of the electrode in the slag result in (measured) electrode weight becoming a function of electrode immersion depth.

All of these considerations limit the accuracy and response of prior art melt rate control schemes. As an example, a typical, commercially available ESR melt rate controller utilizes a twenty minute window to compute melt rate. This slow response time has been determined by equipment manufacturers to be necessary in order to filter out the induced noise. The interaction of the averaging time with the process induced weight variations results in an oscillation in the melt rate controller and effectively limits the accuracy of melt rate control. This limitation requires conservative processing parameters and, as a result, excess costs are incurred. Further, anomalies in the feed stock such as shrinkage cavities or "pipe" result in severe difficulties in the processing of segregation sensitive materials.

The present invention provides a much more accurate means of determining melt rate, namely by counting individual droplets, and thus an improved means of controlling the ESR process. Droplet counting has been possible in vacuum arc remelting (VAR) because so-called drip-shorts are easy to detect in the direct current (DC) based VAR systems. However, it has not heretofore been possible to count individual droplets in alternating current (AC) based ESR systems.

SUMMARY OF THE INVENTION (DISCLOSURE OF THE INVENTION)

The present invention is of an apparatus and method for controlling metals processing comprising: melting a metal electrode; and counting molten metal droplets during melting. In the preferred embodiment, melting is electro-slag remelting. An approximate amount of metal in each droplet is determined, and a melt rate is computed from results of counting and determing. Impedance of the melting circuit is monitored, such as by calculating by root mean square of voltage and current of the circuit and dividing the calculated current into the calculated voltage. Analysis of the impedance signal is performed to look for a trace characteristic of formation of a molten metal droplet. This may involve monitoring impedance skew rate, curvature, or higher moment.

A primary object of the present invention is to determine melt rate by counting individual metal droplets formed during the ESR process.

A primary advantage of the present invention is improved accuracy over reliance only on prior art strain gauge based load cell systems.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

The present invention is a method and apparatus for detecting individual metal droplets during an ESR melt. By counting droplets and empirically determining an approximate quantity of metal in each droplet, melt rate determinations can be made over both long and short periods of time, and adjustments made to the melt input parameters accordingly.

Figure 1:
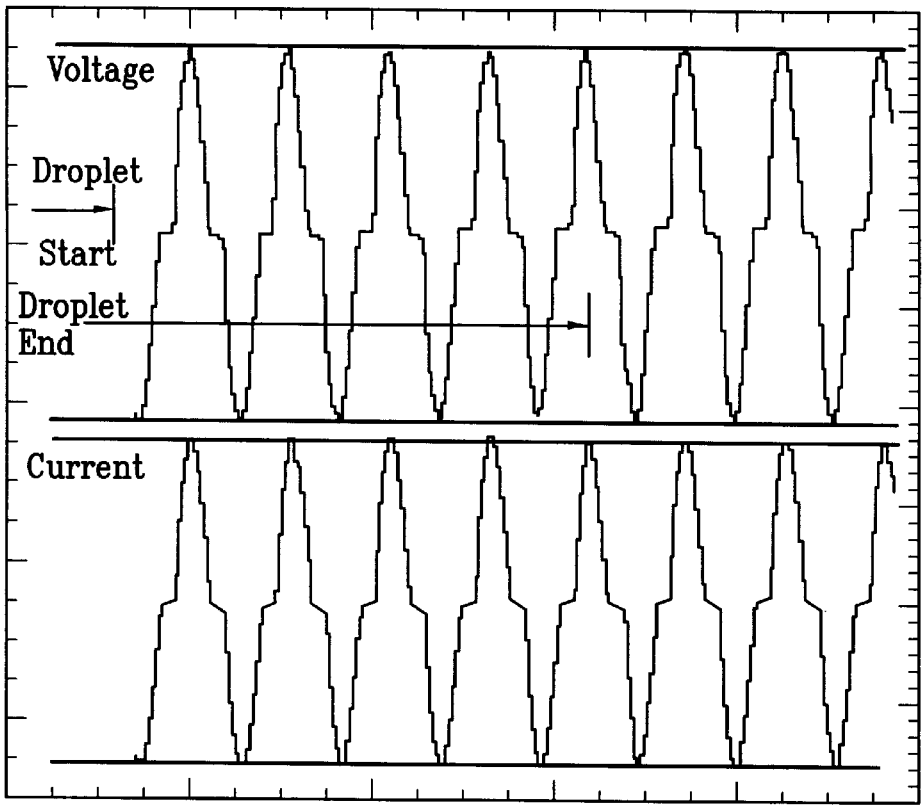
FIG. 1 is an exemplary graph of 60 Hz ESR voltage and current waveforms during metal droplet formation and after droplet release.

It has been determined that certain acoustic events during an ESR melt are accompanied by an increase in current and a decrease in voltage, as illustrated in FIG. 1. These phenomena correspond to molten metal droplets partially shorting out the slag and then exploding as the current density becomes too high. FIG. 1 illustrates this with a decreasing magnitude in the peak to peak voltage value as the droplet forms, followed by a sudden 'snap back' up to the original voltage as the droplet breaks off. The relative magnitude of the effect is quite small, typically occurring at levels heretofore considered noise. However, it is extremely difficult to differentiate the acoustic emission associated with droplets from other acoustic signals and further, the number of droplets detected via acoustic means is often insufficient for the known melt rate, implying that not all droplets exploded.

Figure 2:
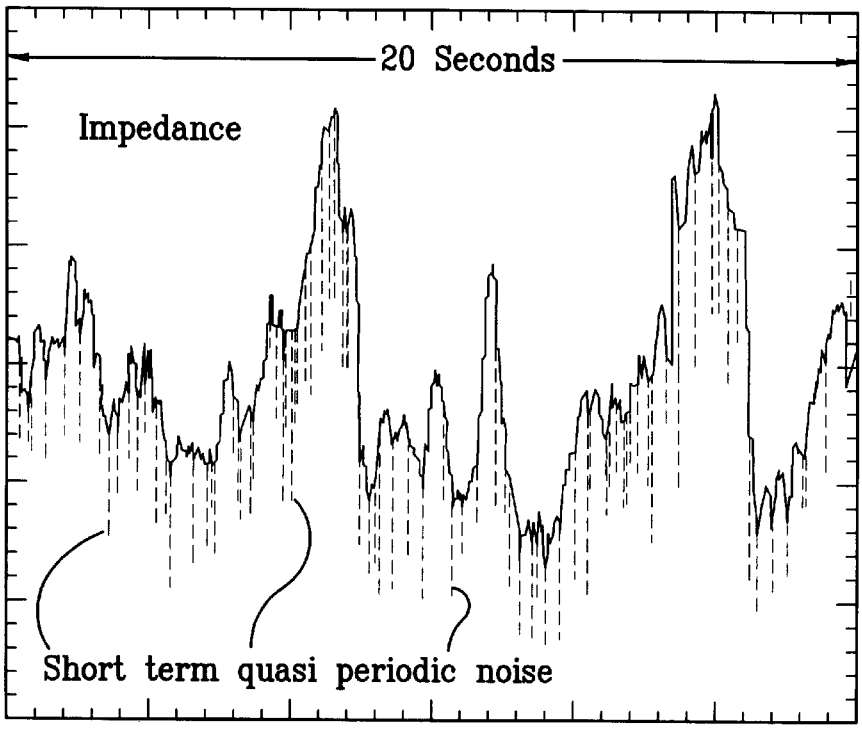
FIG. 2 is an exemplary graph of quasi-periodic noise in ESR impedance signals.

It was then discovered that the voltage variation inherent in the process was the result of impedance variation within the slag/electrode system. In order to monitor these variations, impedance may be continuously monitored, preferably by a fast root mean square (RMS) calculation of voltage and current and then dividing current into voltage to get impedance (according to ohms law). Such a calculated impedance signal contains a small quasi-periodic structure as shown in FIG. 2. The structure is comprised of small, sharp decreases in the system impedance, which correlate to steady state melt rates. Approximate droplet size associated with molten metal transfer in ESR, combined with droplet counts, produces a resultant molten metal transfer rate that is roughly equivalent to the melt rate as measured by load cells.

The physico-electrical basis for the above has been determined to be as follows: In ESR melting, current is passed from an electrode, through a bath of molten slag and into the forming ingot. Since the slag has a much higher resistivity than the metal of the electrode, most of the power applied to the system is dissipated within the slag. This power is dissipated as heat within the slag and serves to heat the slag, maintaining a molten slag bath and raising the slag temperature up beyond the melting point of the metal electrode. The electrode, which is controlled to be continuously immersed within the molten slag, then melts, much as an icicle. The droplets which are associated with the melting of the electrode first form as a molten metal layer. As melting continues this molten metal layer coalesces and begins to form droplets. As a droplet forms, the molten metal of the droplet begins to hang down from the face of the electrode immersed in the slag. Because the molten metal has a much lower resistivity than the molten slag, a forming droplet may effectively short circuit some small portion of the slag. This effect of droplet formation slightly lowers the overall impedance of the slag bath. This change in impedance is visible as a slight decrease in the AC voltage across the furnace and as a slight increase in the current passing through the system. Although the effect is visible on both the voltage and current waveforms (as shown in FIG. 1), the opposite actions of the two signals makes impedance, or voltage divided by current a more obvious indication of the effect.

Figure 3:
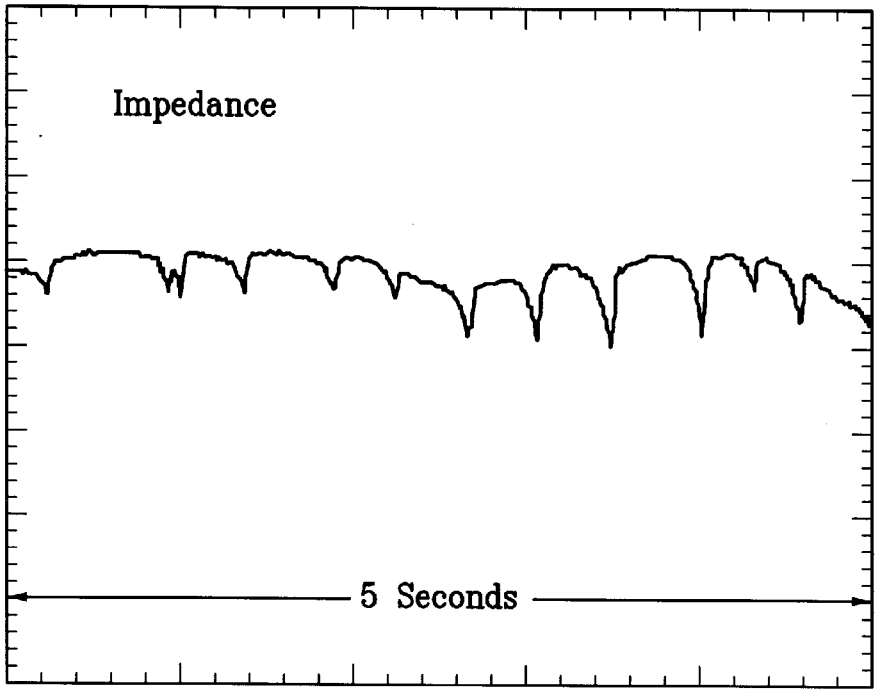
FIG. 3 is an exemplary graph of ESR droplet characteristic waveforms in the impedance signal.

Examination of the waveform data as shown in FIG. 1 reveals that a true RMS value for voltage and current is not required and that peak to peak waveform values may be utilized as effectively while simultaneously reducing the computational effort. In such a scheme the peak to peak values of voltage and current are calculated at every one half cycle, which in the United States is a 120 Hertz rate (100 Hertz in Europe and most of Japan). These peak to peak values may then be divided one into the other to arrive at a number that is representative of impedance. Utilizing this methodology, the resultant signal shows a trace which is characteristic of molten metal droplets within the ESR. FIG. 3 is an example of the characteristic signal associated with molten metal droplets in ESR.

Figure 4:
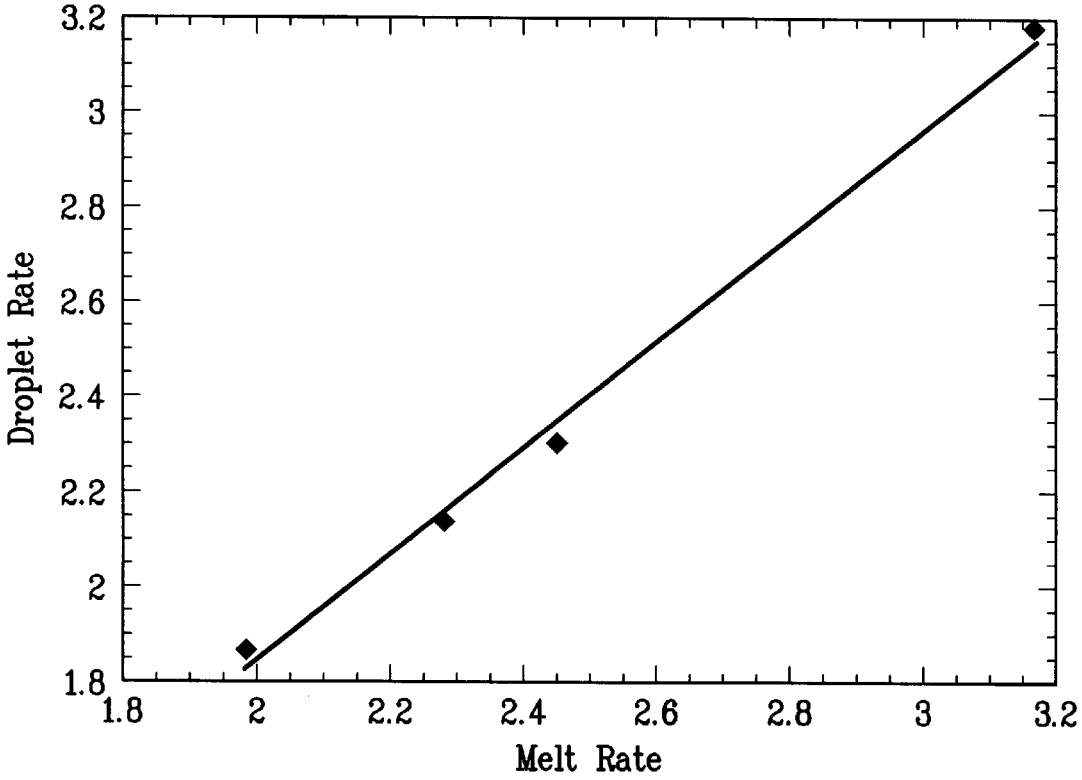
FIG. 4 shows correlation of melt rate to droplet rate.

Droplet size is a direct result of surface tension and liquid density. Both density and surface tension are temperature dependent quantities. Since the liquid that comprises the droplet is in close contact with solid material, it must be near the alloy liquidus temperature and as a result droplet temperatures are not expected to vary. As such, droplet size is thought to be fairly uniform for a given alloy/slag system. FIG. 4 is a plot of droplet rate versus melt rate. FIG. 4 represents data obtained from three different melts using the same alloy and slag. As may be seen, FIG. 4 illustrates a substantially linear relationship between droplet rate and measured melt rate. Therefore, FIG. 4 indicates that droplet rate may effectively be employed as a direct measure of molten metal transfer.

Figure 5:
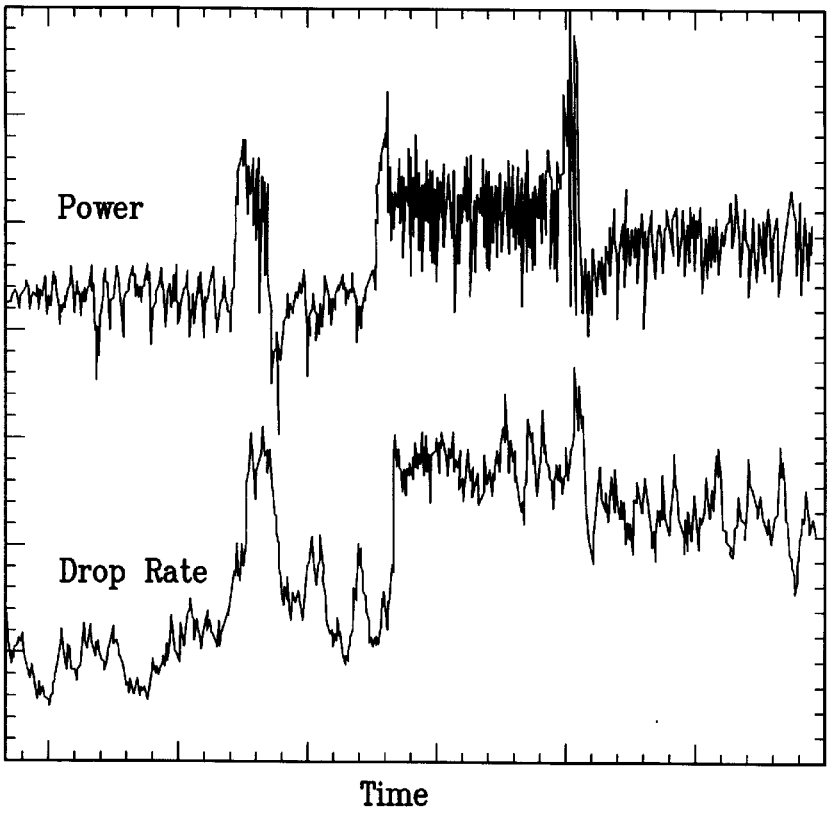
FIG. 5 is an exemplary graph of ESR power and droplet rate versus time.

An indication of the improved responsiveness that may be realized by utilizing droplet counts as a means of melt rate determination may be observed by comparing power input to droplet rate. FIG. 5 demonstrates the increased responsiveness that may be achieved by processing droplet counts. FIG. 5 covers a 40 minute window showing power input and droplet rate versus time. As may be observed, the droplet rate shows an almost immediate response to a change in power input. This is a significant improvement over the industrial standard 20 minute averaging time. Further, the good correlation indicates that an effective melt rate control is readily achievable. This data demonstrates that when contrasted to the current state of the art, a droplet based melt rate controller represents a substantial improvement of traditional methods for melt rate and solidification rate control in ESR.

A system which uses droplet rate to measure melt rate will not be prone to many of the errors which may occur as a result of a mechanical load cell system. These errors include buoyancy effects and melting current effects. Such a system represents a much more robust relative measure of melt rate. The accuracy of such a droplet based system in an absolute sense is somewhat limited in that small errors in the droplet size used in calculations will accumulate, and further, electrical noise associated with arcing which may occur at shallow immersions can cause false counts. However when a droplet counter is coupled with a load cell system, the weight measurement may be effectively utilized as an adaptive means of determining and redetermining droplet size.

Figure 6:
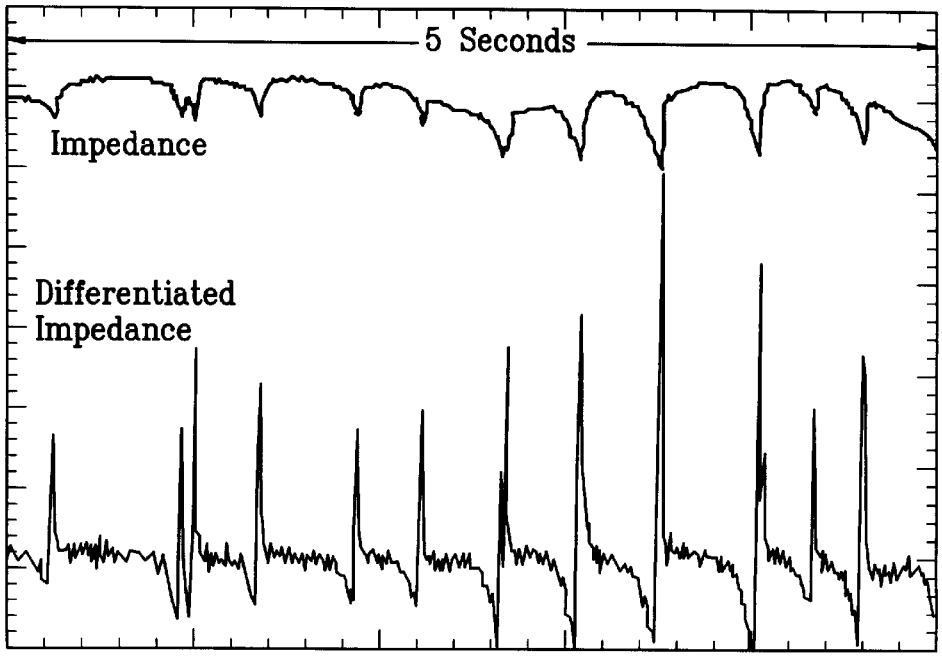
FIG. 6 is an exemplary graph of impedance and differentiated impedance to improve ability to detect droplets.

In order to effectively use droplets as a measure of molten metal transfer rate, a robust detection method must be utilized. If the impedance data of FIG. 3 is examined, then it becomes clear that the impedance skew rate at droplet termination is quite large. As a result, differentiating the impedance and monitoring the rate of change in the impedance value results in a signal which may be thresholded to differentiate (and count) droplets. Such a differentiated signal is illustrated in FIG. 6. Similar results may be obtained with higher moments of the impedance signal, and aside from the slope, both the curvature and the skewness of impedance have been evaluated. These results indicate that higher moments of the impedance signal may also be used for drop discrimination.

Droplet rates are expected to be on the order of 1–6 per second. This means that statistically significant rates may be achieved within a minute or two. As such, a droplet based melt rate controller will be much more responsive than current load cell based systems. In addition, the 20 minute sample time usually used for melt rate measurements with load cells may be used as a method for correcting the assumed droplet size distribution. This correction may be useful in avoiding errors in melt rate which could occur as the slag composition, and hence droplet size, changes during the process. The addition of droplet size calculation changes droplet counting from a relative to an absolute measure of melt rate. It is important to note that utilizing droplets as a method of determining melt rates in ESR is a technique which is applicable regardless of power supply mode (constant current, constant voltage, constant power, cycled current, etc.), regardless of electrode positioning scheme (voltage error, impedance error, constant speed, etc.) and regardless of slag chemistry or any other system characteristic. This technique may also be used in vacuum arc remelting (VAR) melting as well.

Peak reading voltage and current measurements may be used as a means of detecting molten metal droplets in ESR. Combination of these signals into a measure of impedance makes the effect of droplets on the signal more pronounced. Differentiation (or higher moments) provides a signal within which droplets may be easily counted. This technique then is proposed as a means of detecting molten metal droplets in ESR. These droplets provide a more robust, accurate and higher speed and faster response means of determining melt rate within the ESR process. A control system for melt rate is proposed using these droplet signatures. The load cell system would provide a measure of droplet size and allow an absolute determination of melt rate.

The proposed system has higher response and eliminates problems and oscillations associated with load cell based systems. These performance advantages could have substantial impact on ESR solidification and chemistry control, and hence production rates and processing capabilities.

INDUSTRIAL APPLICABILITY

The invention is further illustrated by the following non-limiting examples.

EXAMPLE 1

Figure 7:
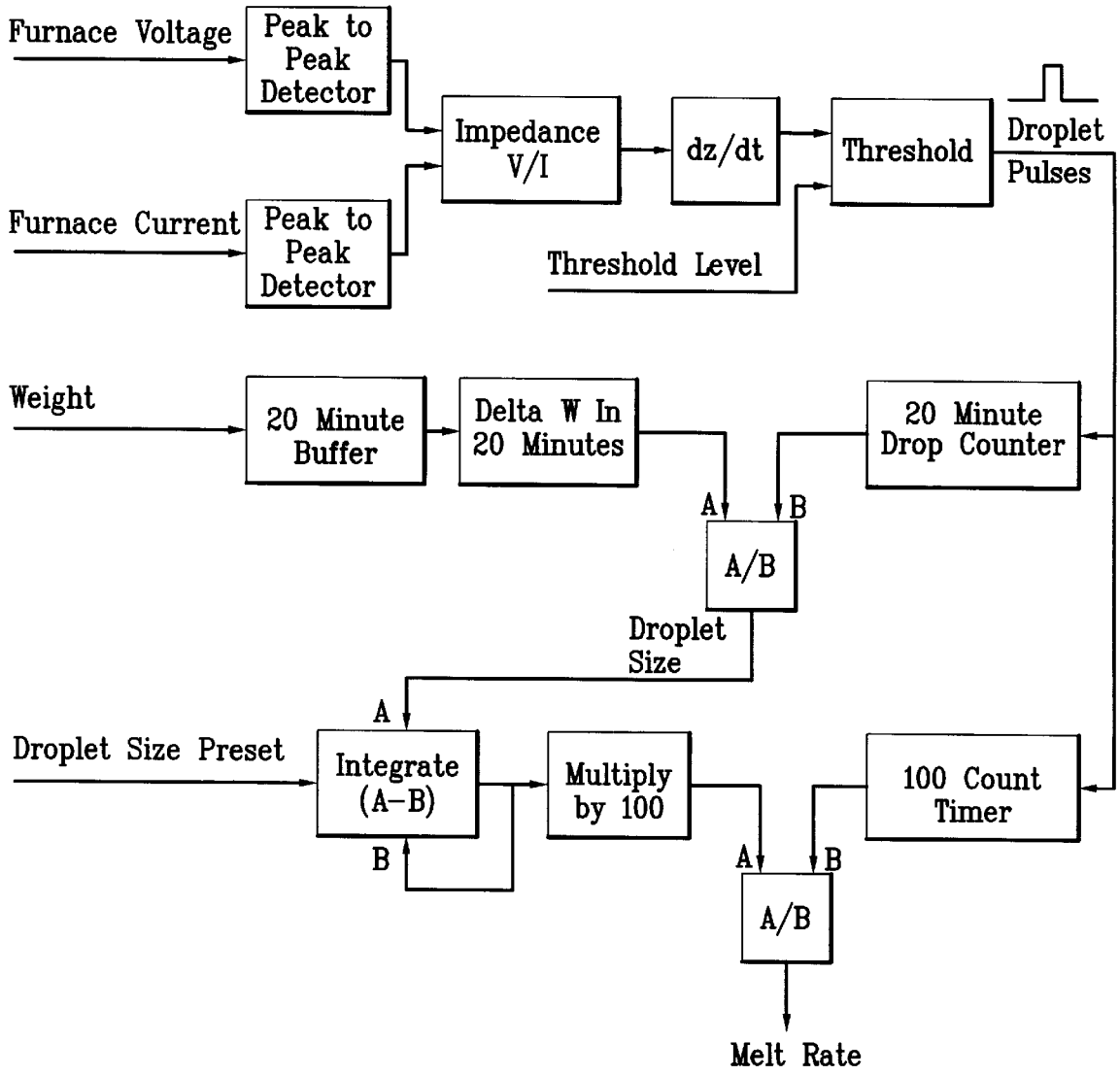
FIG. 7 is a schematic diagram of an exemplary control system and method of the invention as discussed in Example 1.

An exemplary system for determining melt rate from droplets is shown schematically in FIG. 7. The furnace voltage and current are evaluated over a one half line cycle period for the value which yields the greatest absolute value. These signals represent the half wave peaks of the periodic voltage and current wave forms. These operations are performed by the Peak to Peak Detectors. The peak impedance is then calculated by dividing the peak current into the peak voltage. Whenever a droplet forms, the electrical signals show a characteristic drop in voltage commensurate with a rise in current. By dividing current into voltage, the magnitude of this effect is amplified. In addition, the change in the impedance associated with a droplet has an onset which is several line cycles in duration, but the droplet terminates within a half cycle. Therefore, the rate of change in the cycle to cycle peak impedance is calculated. This rate of change value is then compared to a threshold level and if the rate of change that would be associated with a droplet termination is greater than the threshold value, a droplet is said to have been detected. For melt rate determination, the time required for 100 drops is calculated and this time is divided into the calculated weight of 100 drops to yield the process melt rate.

Because the exact droplet size is unknown, and may vary, the weight of 100 droplets is continuously calculated. To accomplish this, the droplet size over the preceding 20 minute period is calculated by dividing the number of drops which occurred over that period into the change in electrode weight. This calculation yields the average size of a droplet over the preceding twenty minutes. This droplet size is then fed into an integrator. The new drop size is compared to the previous drop size and if there is a difference, then the drop size used for melt rate calculation will proceed towards the new value in a controlled fashion. This step is essentially a noise filter. The resultant filtered drop size is then multiplied by 100 and used with the time required for 100 counts to calculate the melt rate.

This methodology is designed to extract the maximum amount of signal from the furnace environment. In addition, so long as the incidence of overlapping drops is statistically regular, the calculated melt rate will be relatively immune to such occurrences. This is accomplished by using the same drop counter for both melt rate and droplet size, providing a situation where overlapping droplets become self correcting.

EXAMPLE 2

Experiments were performed with various slag additives to determine the chemistry of the slag influences drop radius (r) as suggested by the following equation:

$$r = \left(\frac{3\sigma}{g(\rho_m - \rho_s)}\right)^{0.5}$$

where g=980 $cm^2$/sec,

σ=interfacial surface tension (dyne/cm), $P_m$=density of the liquid metal (g/cc), and $P_s$=density of the slag (g/cc).

Figure 8:
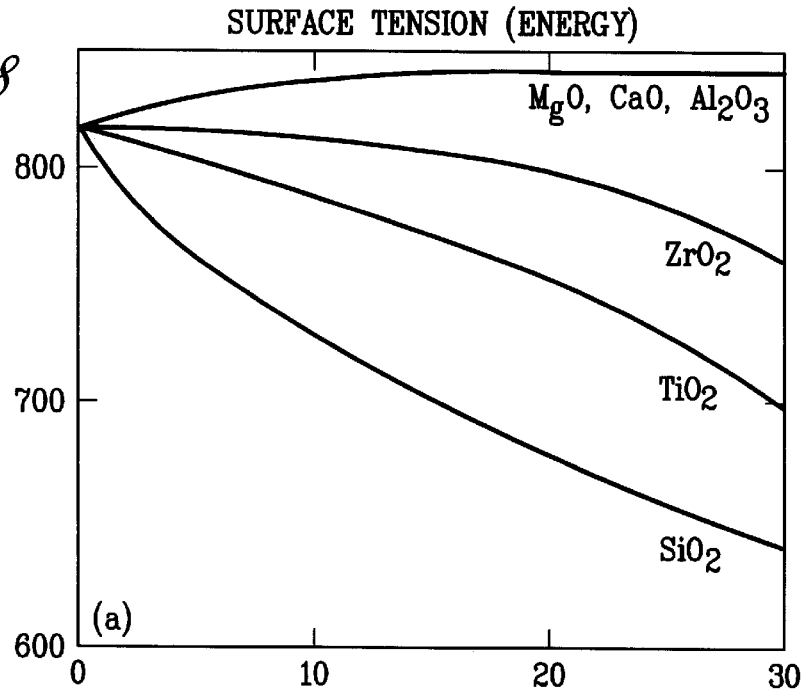
FIG. 8 is a graph of CaF2 slag/liquid low alloy steel interfacial tension at 1550° C. for Example 2.
Figure 9:
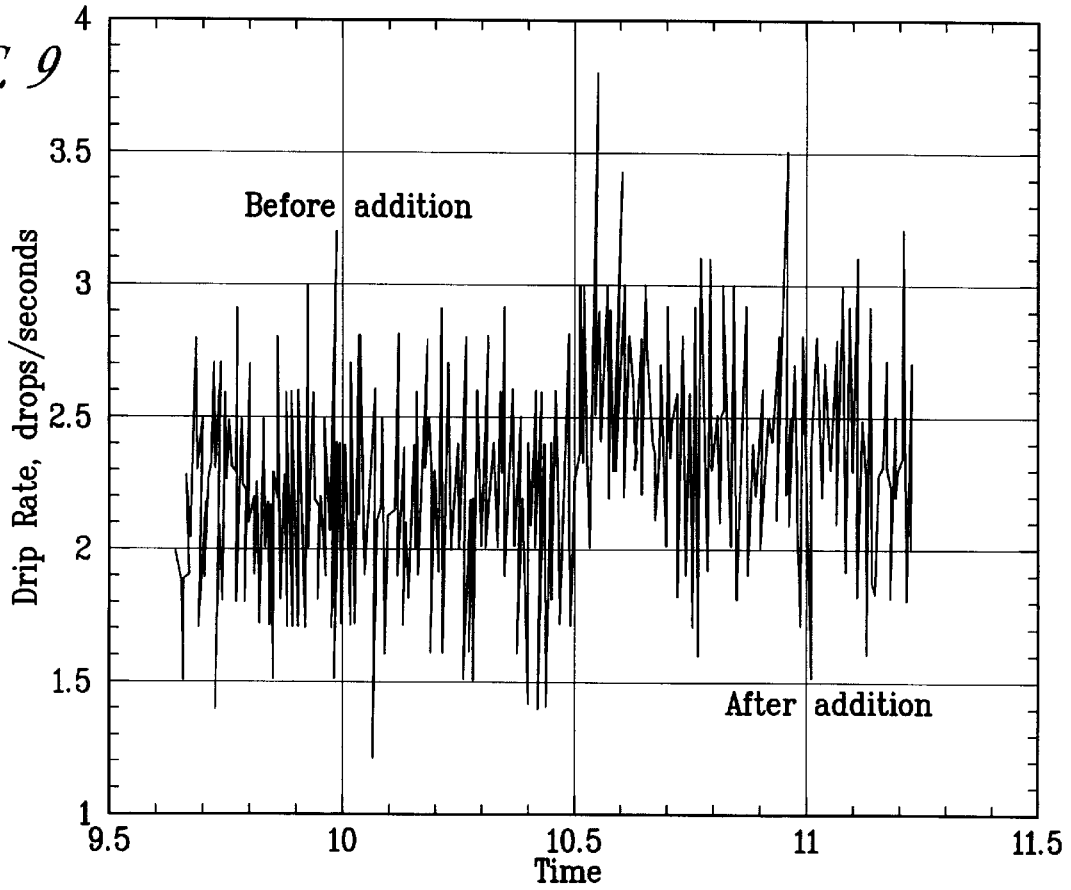
FIG. 9 is a graph for Example 2 showing the change in drop rate resulting from addition of $SiO_2$ to the slag.

According to this relationship, the size of molten metal drops on an ESR should depend on the interfacial tension and the density difference between the molten metal and the slag. The interfacial tension between the molten metal and the slag was changed by the addition of specific oxides during melting and comparing calculated drop size before and after the addition. For example, 1 kg of $SiO_2$ was added to a mild steel melt (E108) running with 12 kg of 33/33/33 slag. According to FIG. 8, this should have lowered the interfacial tension between the slag from approximately 810 mN/m before the $SiO_2$ was added to approximately 720 mN/m after the addition. This resulted in an increase in drop rate from an average of 2.17 drops/sec before the addition to an average of 2.40 drops/sec after the addition, indicating a decrease in drop size of 1.4 grams/drop, as shown in FIG. 9.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method of determining electroslag remelting (ESR) melt rate comprising the steps of:

melting a metal electrode by ESR, said electrode producing a plurality of droplets;

counting molten metal droplets from the electrode during the melting step;

determining the average weight of each droplet; and calculating the melt rate from the number of droplets and the average weight of each droplet.

2. The method of claim 1 wherein the counting step comprises monitoring impedance of an electrical circuit applying power to the electrode.

3. The method of claim 2 wherein the step of monitoring impedance comprises calculating by root mean square a voltage and current of the circuit and dividing the calculated current into the calculated voltage.

4. The method of claim 2 wherein the step of monitoring impedance comprises analyzing an impedance signal for a trace characteristic of formation of a molten metal droplet.

5. The method of claim 2 wherein the step of monitoring impedance comprises monitoring impedance skew rate.

6. The method of claim 2 wherein the step of monitoring impedance comprises monitoring impedance curvature.

7. The method of claim 2 wherein the step of monitoring impedance comprises monitoring one or more moments of impedance.

8. The method of claim 1 wherein the determining step comprises dividing the change in weight of the electrode over a first period of time by the number of droplets during that period.

9. The method of claim 8 wherein the calculating step comprises dividing the average weight of a number of droplets by the sampling time for that number of droplets.

10. The method of claim 9 wherein the average weight of the number of droplets is obtained by using an integrator to integrate the difference between the output of the determining step and the output the integrator, and multiplying the output of the integrator by the predetermined number of droplets.

* * * * *